United States Patent [19]

Fajner et al.

[11] Patent Number: 4,806,897

[45] Date of Patent: Feb. 21, 1989

[54] OVERLOAD RELAY HAVING ADAPTIVE DIFFERENTIAL MECHANISM

[75] Inventors: Michael J. Fajner, Bayside; Edward A. Mallonen, New Berlin; John J. Siebenlist, Milwaukee, all of Wis.

[73] Assignee: Eaton Corporation, Cleveland, Ohio

[21] Appl. No.: 134,811

[22] Filed: Dec. 17, 1987

[51] Int. Cl.[4] ..... H01H 61/06; H01H 71/16

[52] U.S. Cl. ..... 337/49; 337/46

[58] Field of Search ..... 337/49, 48, 47, 46, 337/45

[56] References Cited

U.S. PATENT DOCUMENTS

| | | | |
|---|---|---|---|
| 3,451,024 | 6/1969 | Fantini | 337/49 |
| 3,800,260 | 3/1974 | Woodger | 337/49 |
| 4,096,465 | 6/1978 | Fryer | 337/49 |
| 4,520,244 | 5/1985 | Forsell et al. | 200/67 DA |
| 4,528,539 | 7/1985 | Forsell et al. | 337/49 |

*Primary Examiner*—H. Broome

*Attorney, Agent, or Firm*—Andrus, Sceales, Starke & Sawall

[57] ABSTRACT

In a plural phase overload relay, a pivot lever (12) is mounted to the ambient compensator deflector (9), and a second pivot lever (34) is mounted to both driver and follower slide bars (36 and 38) and driven thereby to engage and pivot the first lever on the ambient compensator deflector to trip a cut-out switch. The ambient compensator deflector adjusts both the three phase current trip threshold and the loss of phase current trip threshold, and also affords ambient compensator of each. A constant ratio relationship between these two thresholds is provided throughout the entire range of current trip threshold settings. The driver bar moves a first distance for three phase trip and a second shorter distance for loss of phase trip. The ratio of these distances is constant notwithstanding adjustment by the ambient compensator deflector changing the length of such distances.

17 Claims, 3 Drawing Sheets

OVERLOAD RELAY HAVING ADAPTIVE DIFFERENTIAL MECHANISM

BACKGROUND AND SUMMARY

The invention relates to multiphase electrical overload switching relays for protecting a load from overcurrent conditions in one or all of the phases.

Overload relays and switches are known in the art, for example as shown in Woodger U.S. Pat. No. 3,800,260, Fryer U.S. Pat. No. 4,096,465 and Forsell et al U.S. Pat. Nos. 4,520,244 and 4,528,539, incorporated herein by reference.

The present invention and the prior art provides cutout switching for a three phase overcurrent condition mode and for a loss of phase overcurrent condition mode. The present invention further includes improvements providing a constant ratio relationship of the above modes throughout all ranges of current settings by means of adaptive compensation.

The relay trips in response to a mean value of currents in all phases exceeding a first threshold. The relay also trips in response to loss of current in one of the phases when current in another phase exceeds a second threshold. The first threshold is greater than the second threshold. The invention includes an ambient compensator adjusting both thresholds, affording ambient compensation of the mean value of currents in all phases and affording ambient compensation of single phase loss. Current responsive deflectors, e.g. bimetals, drive transfer actuator structure which moves a first travel distance corresponding to the first threshold and a second travel distance corresponding to the second threshold. The ambient compensator adjusts the length of the first travel distance to adjust the first threshold, and also adjusts the length of the second travel distance to adjust the second threshold. The ratio of the second travel distance to the first travel distance is constant notwithstanding adjustment by the ambient compensator changing the lengths of the first and second travel distances.

DESCRIPTION OF PRIOR ART

Figure 1:
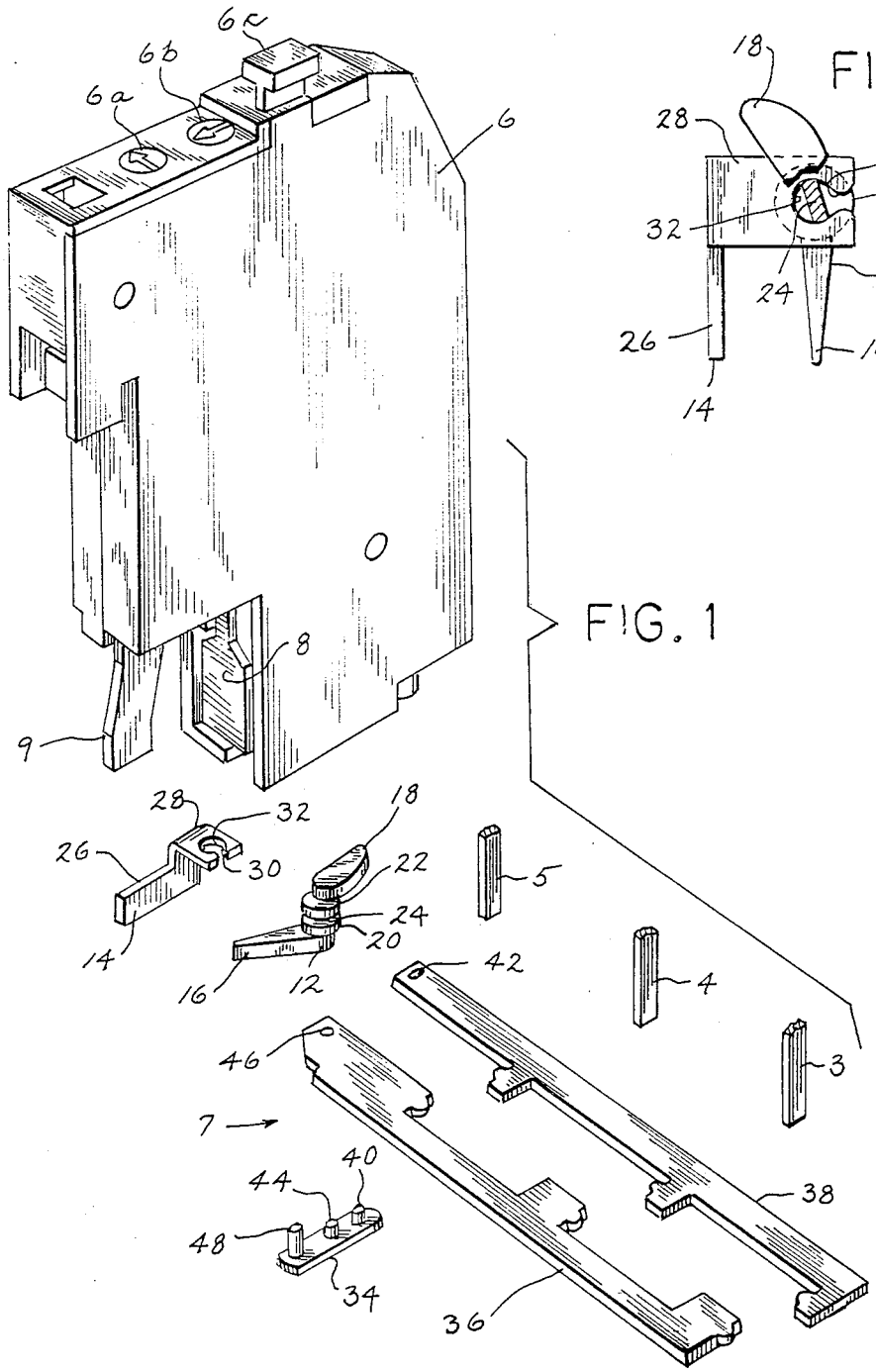
FIG. 1 is an exploded perspective view of a portion of an overload relay with transfer actuator structure in accordance with the invention.

FIG. 1 shows a portion of a three phase overload relay, including a plastic insulating housing, as shown at 2 in incorporated U.S. Pat. No. 4,528,539 with three compartments each containing a current responsive deflector, as shown at respective bimetals 3, 4 and 5, and having a switch compartment 6 containing a snap-action switch for disconnecting a load from a power supply. The switch is shown in incorporated U.S. Pat. Nos. 4,520,244 and 4,528,539. There is one bimetal for each current phase. As known in the art, each bimetal is heated by the current of its respective phase flowing through a heater in close proximity to the bimetal, such that the bimetal deflects in response to such current. In FIGS. 1–4, bimetals 3–5 move leftwardly to drive transfer actuator structure 7, to be described, to trip switch plate 8 and actuate the cut-out switch. This basic actuating scheme is known in the art. In U.S. Pat. No. 3,800,260, bimetals 10 have heater coils 11 and deflect leftwardly to drive the transfer actuator structure provided by slide plates 14 and 15 to trip switch plate 16, FIGS. 3 and 4. In U.S. Pat. No. 4,096,465, bimetals 10*a*, FIG. 4, deflect leftwardly to drive driver plate 14 and follower plate 15 to trip switch plate 16 via lever 18. In U.S. Pat. No. 4,528,539, bimetals 16*k*, 18*k* and 20*k*, FIGS. 9–11, deflect leftwardly to drive the actuator structure provided by driver bar 30 and follower bar 32 to trip switch 26 via crank 28.

It is known in the art to provide adjustment for the length of travel of the transfer actuator structure to adjust the current trip thresholds, and also to provide ambient compensation for such travel. For example, in a high ambient temperature environment, the bimetals may already be pre-deflected a certain extent. In FIGS. 1–4, this adjustment and ambient compensation is provided by another bimetal 9 which may be adjusted to move right-left toward or away from the transfer actuator structure, and which also deflects according to ambient temperature. In U.S. Pat. No. 3,800,260, bimetal strip 24 provides adjustment and ambient compensation. In U.S. Pat. No. 4,096,465, bimetal strip 24 provides adjustment and ambient compensation. In U.S. Pat. No. 4,528,539, bimetal member 24 provides adjustment and ambient compensation. In FIG. 1, adjustment screw 6*a* adjusts the left-right position of compensator 9 for trip current selection, selector 6*b* selects automatic reset of the switch or manual reset by reset button 6*c*, as in U.S. Pat. Nos. 4,528,539 and 4,520,244.

DESCRIPTION OF INVENTION

Figure 6:
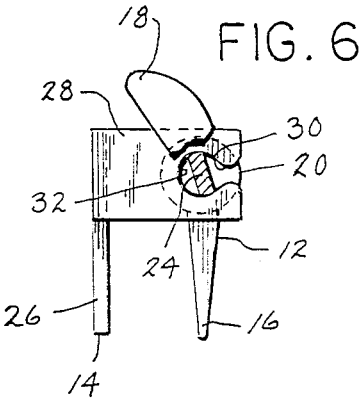
FIG. 6 is an isolated view of a portion of the structure of FIG. 1.

The present invention provides improvements in the transfer actuator structure 7. A pivot lever 12 is pivotally mounted to a holder 14 which is welded to ambient compensator 9. Pivot lever 12 is a molded plastic member having a lower arm 16, an upper arm 18, and a pair of central annular shoulders 20 and 22 connected by a central flat key section 24, FIG. 6. Holder 14 has a first vertical portion 26 welded to compensator 9, and an upper horizontal ledge portion 28 with a slot having a narrow entrance opening 30 and a wider circular section 32. During assembly, pivot lever 12 is turned to enable flat key section 24 to pass through opening 30. Pivot lever 12 is supported in opening 32 with shoulder 22 on the top side of ledge 28, and shoulder 20 on the bottom side of ledge 28, and with key portion 24 in opening 32.

A second pivot lever 34 is pivotally mounted to a driver slide bar 36 and to a follower slide bar 38. The slide bars are driven leftwardly by deflection of bimetals 3–5, FIGS. 3 and 4. Pivot lever 34 has a first upstanding trunnion 40 received in slightly elongated slot 42 at the left end of follower bar 38. Pivot lever 34 has a second upstanding trunnion 44 received in opening 46 at the left end of driver bar 36. Pivot lever 34 has a third upstanding trunnion 48 of greater height than trunnions 40 and 44 and moveable into engagement with arm 16 of pivot lever 12.

Figure 2:
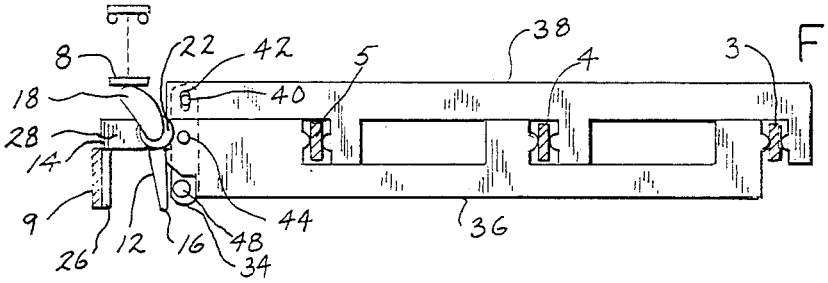
FIG. 2 is a view of the transfer actuator structure of FIG. 1, for illustrating operation.

FIG. 2 shows a nonactuated position with trunnion 48 spaced rightwardly of pivot lever arm 16. In response to three phase overload, i.e. the mean value of current in all phases exceeds a first given threshold, bimetals 3–5 deflect leftwardly, FIG. 3, driving driver bar 36 leftwardly, and follower bar 38 follows. Pivot lever 34 is translated leftwardly and trunnion 48 engages arm 16 and pivots lever 12 to trip switch 8.

Figure 4:
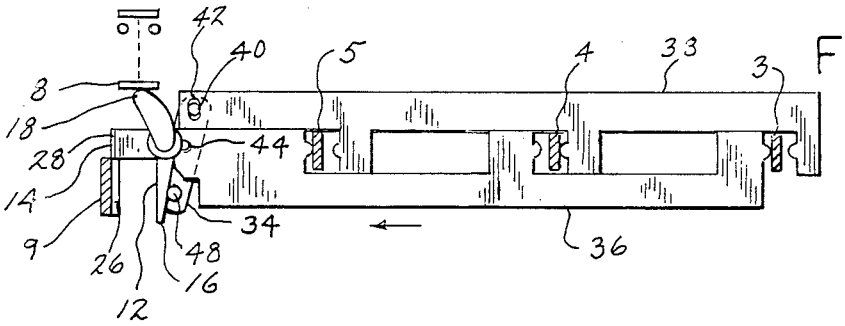
FIG. 4 is a view like FIG. 2 and illustrates loss of phase operation.
Figure 5:
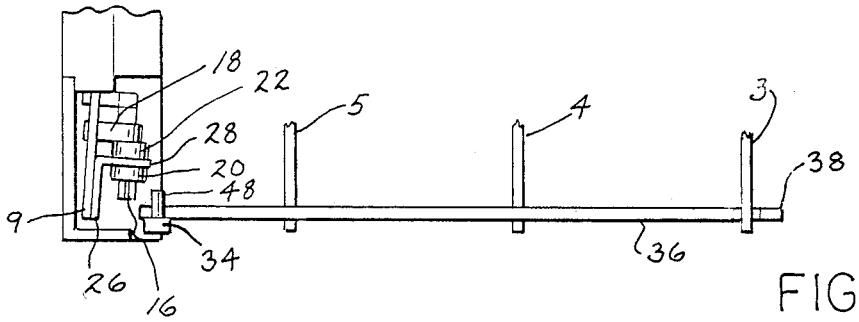
FIG. 5 is a side view of the structure of FIG. 2.

FIG. 4 shows actuation when there is a loss of current in one of the phases. If there is a loss of current in the phase corresponding to bimetal 4 and if the mean value of the current in the remaining phases exceeds a given second threshold, then driver bar 36 will be driven leftwardly by the leftward deflection of bimetals 3 and 5, while follower bar 38 is held back by the nondeflection of bimetal 4. Pivot lever 34 is driven by driver bar 36 to pivot about trunnion 40 which slides slightly downwardly in slot 42. Trunnion 48 engages arm 16 to pivot lever 12 and trip switch 8. The noted second current trip threshold is less than the noted first current trip threshold.

Figure 7:
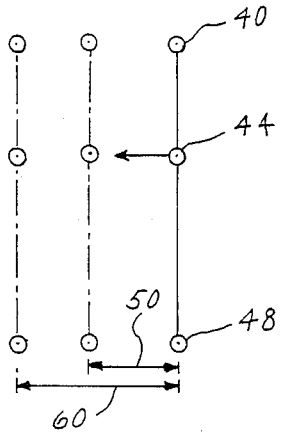
FIG. 7 is a schematic illustration of the adjustable translational travel of the actuator structure of FIG. 3.

As shown in FIG. 7, trunnions 40, 44 and 48 move translationally leftwardly in unison when both slide bars 36 and 38 move leftwardly in unison such that trunnions 40, 44 and 48 move a given translational travel distance 50, such that trunnion 48 engages and pivots lever 12.

Figure 8:
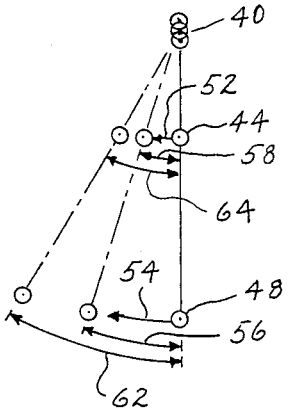
FIG. 8 is a schematic illustration of the adjustable arcuate travel of the actuator structure of FIG. 4.

When follower bar 38 is held back and driver bar 36 moves, FIG. 8, lever 34 pivots about trunnion 40, such that trunnions 44 and 48 swing in arcs 52 and 54 about trunnion 40. The curvature of the arc is reduced by the length of slot 42, FIG. 1, and the arcs may be made essentially flat if slot 42 is long enough. It is preferred that arc 52 be essentially flat to minimize free play and lateral movement of the left end of driver bar 36. Arc 54 need not be flat because trunnion 48 can ride up slightly on pivot lever arm 16. Slide bars 36 and 38 move substantially only longitudinally left-right and accommodate pivoting of lever 34 with substantially no lateral movement of the slide bars. The radius from trunnion 40 to trunnion 48 is longer than the radius from trunnion 40 to trunnion 44, such that pivoting of lever 34 about trunnion 40 defines a longer arc at trunnion 48 than at trunnion 44. When trunnion 48 moves a given arcuate travel distance 56 along its arc 54 corresponding to translational travel distance 50 to engage and pivot lever 12, trunnion 44 moves a given arcuate travel distance 58 along its arc 52 which is less than translational travel distance 50.

When ambient compensator deflector 9 is moved leftwardly, the noted travel distances are lengthened and therefor the first and second threshold values are increased. When compensator 9 is moved rightwardly, the noted travel distances are shortened. For example, when compensator 9 is moved leftwardly, the translational travel distance increases as shown at 60, and the arcuate travel distances increase as shown at 62 and 64. The ratio of arcuate travel distance 58 to arcuate travel distance 56 is the same as the ratio of arcuate travel distance 64 to arcuate travel distance 62, and this ratio remains constant notwithstanding adjustment by ambient compensator deflector 9 changing the lengths of the arcuate travel distances. Arcuate travel distance 56 is substantially the same as translational travel distance 50, and arcuate travel distance 62 is substantially the same as translational travel distance 60, and this relationship stays the same notwithstanding adjustment by compensator 9 changing the lengths of the arcuate and translational travel distances. Arcuate travel distance 58 is less than translational travel distance 50, and arcuate travel distance 64 is less than translational distance 60, and this relationship remains the same notwithstanding adjustment by compensator 9 changing the lengths of the travel distances.

Figure 3:
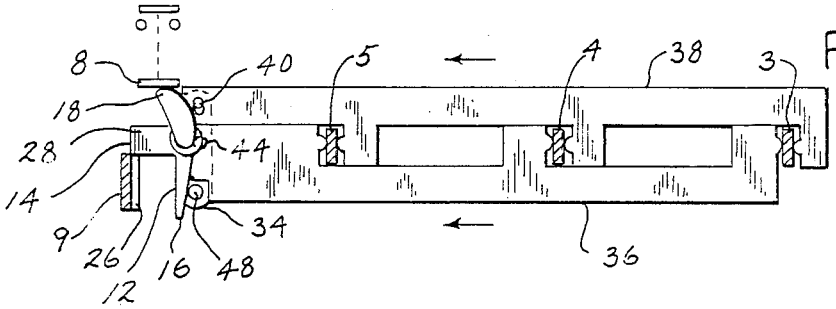
FIG. 3 is a view like FIG. 2 and illustrates three phase operation.

Pivot levers 12 and 34 enable the ambient compensator to adjust both the three phase current trip threshold, FIG. 3, and the loss of phase current trip threshold, FIG. 4, and also affords ambient compensation of both thresholds. The transfer actuator structure at trunnion 44 moves a first travel distance 50, FIG. 7, corresponding to the three phase current trip threshold, and ambient compensator 9 adjusts such length of travel, e.g. to length 60, to adjust the three phase current trip threshold. The transfer actuator structure at trunnion 44 moves a second travel distance 58, FIG. 8, corresponding to the noted loss of phase current trip threshold, and ambient compensator 9 adjusts such second travel distance, e.g. to length 64, to adjust the noted loss of phase current trip threshold. The ratio of travel distance 58 to travel distance 50 is equal to the ratio of travel distance 64 to travel distance 60, and this ratio is constant notwithstanding adjustment by the ambient compensator 9 changing the lengths of such travel distances. This constant ratio is important because it provides the above noted constant ratio relationship of the current trip thresholds throughout all ranges of current trip threshold settings.

It is recognized that various equivalents, alternatives and modifications are possible within the scope of the appended claims.

We claim:

1. A plural phase overload relay comprising a switch, a plurality of current responsive deflectors, one for each phase, which deflect in response to current in the respective phase, an ambient compensator deflector which deflects in response to ambient temperature, a pivot lever mounted on said ambient compensator deflector and pivotable to trip said switch, transfer actuator means responsive to said current responsive deflectors and driven thereby to engage said pivot lever on said ambient compensator deflector and pivot said lever to trip said switch, wherein said transfer actuator means comprises a second pivot lever movable into engagement with said first mentioned pivot lever, wherein said transfer actuator means comprises a pair of slide bars, and wherein said second pivot lever is translated into engagement with said first pivot lever to pivot the latter, and such that when one of said slide bars is held back by one of said current responsive deflectors and the other of said slide bars moves, said second pivot lever is driven by said other slide bar and pivots about said one slide bar into engagement with said first pivot lever to pivot the latter.

2. The invention according to claim 1 wherein:

said second pivot lever has a first pivot point mounted to said one slide bar and a second pivot point mounted to said other slide bar and has a third point engageable with said first pivot lever to pivot the latter;

said first, second and third points move translationally when both said slide bars move such that said first, second and third points on said second pivot lever move a given translational travel distance such that said third point engages and pivots said first pivot lever;

said second pivot lever pivots about said first pivot point when said one slide bar is held back and said other slide bar moves such that said second and third points swing in arcs about said first point, and wherein the radius from said first point to said third point is longer than the radius from said first point to said second point, such that pivoting of said second pivot lever about said first point defines a longer arc at said third point than at said second point, such that when said third point moves a first arcuate travel distance along its arc corresponding to said translational travel distance to engage and pivot said first pivot lever, said second point moves a second arcuate travel distance along its arc less than said translational travel distance.

3. The invention according to claim 2 wherein:

said ambient compensator deflector is adjustable to move said first pivot lever toward and away from said second pivot lever to shorten and lengthen said travel distances;

the ratio of said second arcuate travel distance to said first arcuate travel distance is constant notwithstanding adjustment by said ambient compensator deflector changing the lengths of said first and second arcuate travel distances.

4. The invention according to claim 3 wherein:

said first arcuate travel distance is substantially the same as said translational travel distance notwithstanding adjustment by said ambient compensator deflector changing the lengths of said first arcuate travel distance and said translational travel distance;

said second arcuate travel distance is less than said translational travel distance.

5. The invention according to claim 4 wherein said first pivot point is mounted in a slot in said one slide bar, said slot having a given extension such that said first pivot point moves along the extension of said slot to substantially flatten said travel arc of said second pivot point such that said slide bars move substantially only along said translational direction and accommodate said pivoting of said second pivot lever with substantially no lateral movement of said slide bars.

6. The invention according to claim 4 wherein said first, second and third points on said second pivot lever are provided by first, second and third trunnions, respectively, wherein said third trunnion has a greater height than said first and second trunnions and engages said first pivot lever.

7. The invention according to claim 6 wherein said first pivot lever comprises a central section pivotally mounted to said ambient compensator deflector and having an upper arm for tripping said switch and having a lower arm engaged by said third trunnion.

8. The invention according to claim 7 comprising a holder member attached to said ambient compensator deflector and having a ledge portion with a slot therein receiving and pivotally mounting said central section of said first pivot lever.

9. The invention according to claim 8 wherein said central section of said first pivot lever has a pair of spaced shoulders, and wherein said first pivot lever is supported in said slot of said ledge portion with one of said shoulders on one side of said ledge portion and the other of said shoulders on the other side, of said ledge portion.

10. The invention according to claim 9 wherein said slot in said ledge portion has a narrow entrance opening and a wider circular section, and wherein said shoulders of said first pivot lever are connected by a central flat key section which is turned during assembly to enable such flat key section to pass through said narrow entrance opening and be supported in said wider circular section for pivotal movement.

11. A plural phase overload relay comprising a switch, a plurality of current responsive deflectors, one for each phase, which deflect in response to current in the respective phase, an ambient compensator deflector which deflects in response to ambient temperature, transfer actuator means driven by deflection of said current responsive deflectors, a pair of pivot levers comprising a first pivot lever pivotally mounted on said ambient compensator deflector and pivotable to trip said switch, and a second pivot lever mounted on said transfer actuator means and movable into engagement with said first pivot lever.

12. The invention according to claim 11 comprising a holder member attached to said ambient compensator deflector and having a ledge portion extending therefrom, and wherein said first pivot lever comprises a first arm for tripping said switch and a second arm engaged by said second pivot lever, said first pivot lever having a central section between said arms and pivotally mounted to said ledge portion.

13. The invention according to claim 11 wherein said transfer actuator means comprises a driver slide bar driven by said current responsive deflectors and a follower slide bar following said driver slide bar, said second pivot lever having a first pivot point mounted to said follower slide bar and a second pivot point mounted to said driver slide bar and having a third point engageable with said first pivot lever to pivot the matter.

14. The invention according to claim 13 wherein said first, second and third points move translationally when both said driver and follower slide bars move, such that said first, second and third points on said second pivot lever move a given translational distance and said third point engages and pivots said first pivot lever and wherein said second pivot lever pivots about said first pivot point when said follower slide bar is held back by nondeflection of one of said current responsive deflectors and said driver slide bar moves such that said second and third points swing in arcs about said first point, and wherein the radius from said first point to said third point is longer than the radius from said first point to said second point, such that pivoting of said second pivot lever about said first pivot point defines a longer arc at said third point than at said second point, such that when said third point moves a first arcuate travel distance along its arc corresponding to said translational travel distance to engage and pivot said first pivot lever, said second point moves a second arcuate travel distance along its arc less than said translational travel distance.

15. The invention according to claim 14 wherein said first pivot point is mounted in a slot in said follower slide bar, said slot having a given extension such that said first pivot point moves along the extension of said slot to substantially flatten said travel arc of said second pivot point such that said driver and follower slide bars move substantially only along said translational direction and accommodate said pivoting of said second pivot lever with substantially no lateral movement of said driver and follower slide bars.

16. A plural phase overload relay having a single travel gap for current range adjustment of both three phase trip and single phase loss trip, comprising a switch, a plurality of current responsive deflectors, one of each phase, which deflect in response to current in the respective phase, an ambient compensator deflector which deflects in response to ambient temperature, a pivot lever mounted on said ambient compensator deflector and pivotable to trip said switch, transfer actuator means responsive to said current responsive deflectors and driven thereby to engage said pivot lever on said ambient compensator deflector and pivot said lever to trip said switch in response to a mean value of current in all phases exceeding a first threshold and also to trip said switch in response to loss of current in one of said phases when current in another phase exceeds a second threshold, said transfer actuator means comprising a second pivot lever movable into engagement with said first mentioned pivot lever through a given travel gap, and means for adjusting the length of said gap to adjust each of said first and second current thresholds to provide current range adjustment of both three phase trip and single phase loss trip by adjusting the length of the single said gap.

17. The invention according to claim 16 wherein said second pivot lever moves a first travel distance corresponding to said first threshold, and said second pivot lever moves a second travel distance corresponding to said second threshold, and wherein the ratio of said second travel distance to said first travel distance is constant notwithstanding adjustment by said adjustment means changing the length of said travel gap which changes the lengths of said first and second travel distances.

* * * * *